United States Patent [19]

Wilson

[11] 4,125,206

[45] Nov. 14, 1978

[54] TOOTH PASTE DISPENSER

[76] Inventor: Bobby R. Wilson, 468 Iroquois Ave., Akron, Ohio 44305

[21] Appl. No.: 748,936

[22] Filed: Dec. 9, 1976

[51] Int. Cl.[2] ..... B65D 35/28

[52] U.S. Cl. ..... 222/101

[58] Field of Search ..... 222/101, 105, 390

[56] References Cited

U.S. PATENT DOCUMENTS

| | | | |
|---|---|---|---|
| 1,311,354 | 7/1919 | King | 222/101 |
| 2,772,028 | 11/1956 | Lopez | 222/105 X |
| 2,921,717 | 1/1960 | Borak | 222/105 X |
| 3,232,488 | 1/1966 | Headberg | 222/101 |
| 3,313,454 | 4/1967 | Welsh et al. | 222/105X |

*Primary Examiner*—Robert R. Song
*Assistant Examiner*—Norman L. Stack

[57] ABSTRACT

A device for containing and dispensing a selected amount of the contents within a tube. A box mounted to a plaque within the box is the transverse drive means that drives a carriage vertically. The carriage consists of a roller with horizontally adjusting means.

1 Claim, 4 Drawing Figures

TOOTH PASTE DISPENSER

BACKGROUND

The invention relates to a toothpaste dispenser. It is very annoying to those of us who brush our teeth daily to reach in the medicine cabinet for the tube of toothpaste and then find that it is not in its usual spot. When it is finally located, the cap is missing and the tube is bent all out of shape.

SUMMARY OF THE INVENTION

The object of the invention is to provide a device that is both a decorated wall piece and serves as a toothbrush holder and a toothpaste dispenser, that is centrally located, easily accessible and inexpensive. The device is designed in such a way that the user inserts a tube of toothpaste in the device, tightens the clamps and adjusts the roller. When the handle is turned, a selected amount of toothpaste is dispensed onto the brush held below the opening.

DETAILED DESCRIPTION OF THE INVENTION

Figure 2:
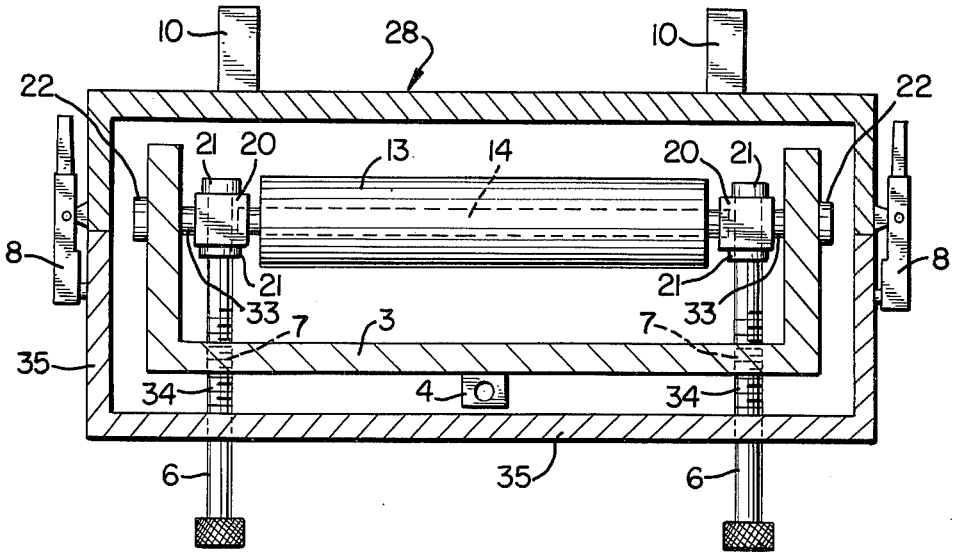
FIG. 2 is a cut away view looking from the top showing parts in relation to each other.

Referring to FIG. 2: The device indicated generally by the numeral 28 consists of a roller 18 mounted on an axle 14. The axle is rotationally secure within the adjusting joints 20. The adjusting joints are slidable mounted within the carriage, indicated generally by the numeral 3, by an axle 33 that is fixed to the outer side of the joints 20 and extends through the elongated slots 5 in the carriage and secured by caps 22.

The tube indicated generally by the numeral 26 is held in place by clamps 9 with the mouth of the tube downward and protruding out of a hole at the bottom of the device. The mouth of the tube is capped by a rubber cap 12, shown in FIG. 3.

Referring to FIG. 2: The device 28 is provided with hinges 11 fixed to the bottom to allow the device to open. There are latches 8 fixed to the sides at the top to keep the device closed.

Figure 1:
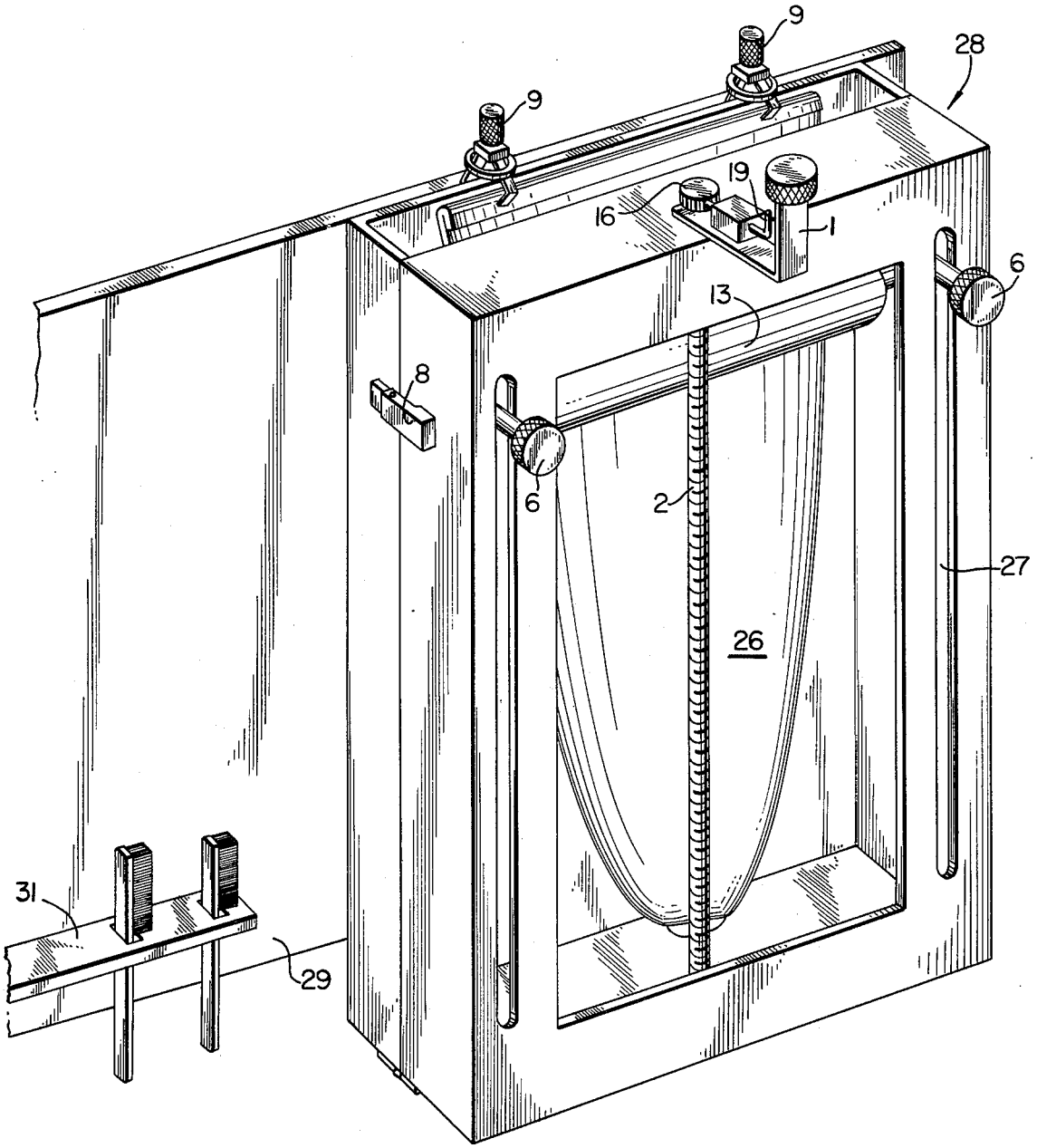
FIG. 1 is a view showing the entire invention mounted on its wall plaque.
Figure 3:
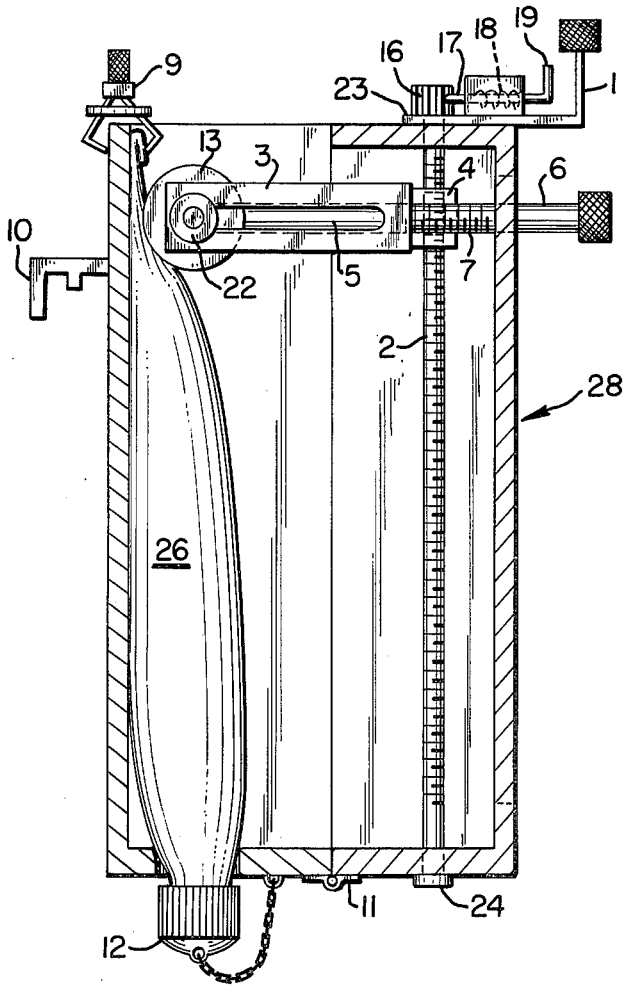
FIG. 3 is a cut away side view showing parts in relation to each other.

Referring to FIG. 3, FIG. 2: Means of adjusting the roller 13 within the elongated slots 5 adjusting screws 6 are provided. The screws, one on each end of the roller 13, are rotationally mounted through the adjusting joints 20 and capped on each end 21 of the adjusting joints. The adjusting screws then protrude through the threaded opening 7 in the carriage 3 that matches the threads 34 on the adjusting screws 6. The screws then continue through the elongated slots 27 running vertically on the device, indicated generally by the numeral 28 in FIG. 1.

Figure 4:
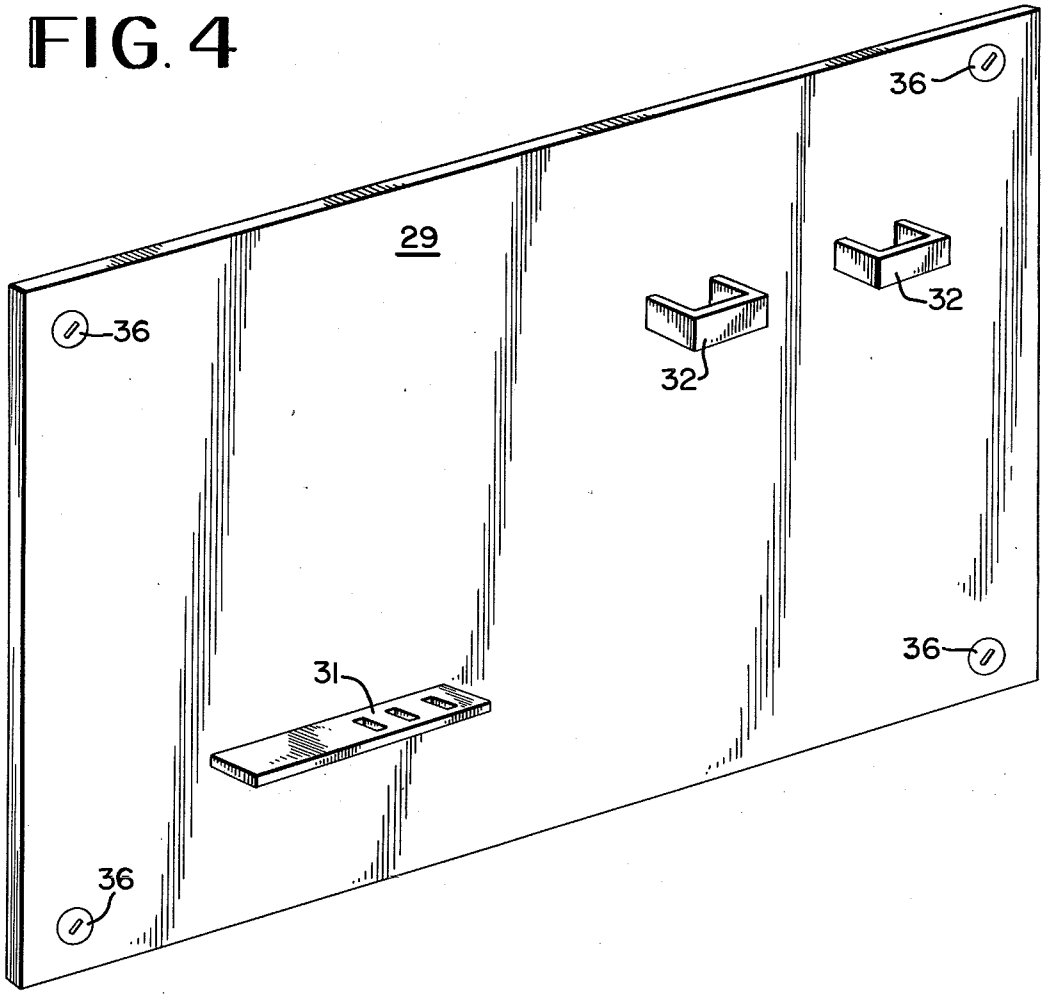
FIG. 4 is a view of the wall plaque showing the toothbrush holders and the dispenser holder.

Referring to FIG. 4: the device is provided with wall mounting means in the form of plaque 29 provided with protruding slots 32, for receiving hooks 10 of the container. The plaque is also provided with toothbrush holders 31, and wall mountings 36.

The carriage, indicated generally by the numeral 3, is provided with a threaded central opening 4 shown in FIG. 2 and FIG. 3. The threaded central opening accepts a threaded rod 2. The threaded rod runs vertically the length of the device and is located at the front of the carriage and in the center of device, shown in FIG. 3. The threaded central opening 4 protruding from the carriage is located respectively to the location of the threaded rod 2. The threaded rod 2 is rotationally mounted at the bottom of the framework by a cap 24 and at the top it is rotationally mounted within the framework with a gear 16 fixed to the upper portion of the threaded rod 2 in between the gear 16 and the framework 25. The handle, referred to generally by numeral 1, extending and coupling 23 the rod 2 is provided with a spring 18 loaded pin. The pin 17 engages with gear 16 to drive rod 2 when handle 1 is turned and disengaged. When handle is returned, as in a ratched fashion since the pin 17 is tapered on one side of the engaging end, it can only drive the rod in one direction. In order to back the carriage up to the top of the device, the pin 17 is provided with a handle 19. By flipping the handle over the rod it can be driven in the reverse direction.

Mode of Operation

By unlatching the latches 8 and placing a tube upside down and clamping it with clamps 9 to the back of the device, then closing and relatching the device, next adjust the roller 13 with the adjusting screws 6 equally against the top of the tube. When handle 1 is turned, the pin 17 drives gear 16 which is fixed to the threaded rod 2. The threaded rod is inserted through a threaded central opening 4 protruding from the carriage. The gear 16 drives threaded rod which in turn drives the carriage 3 and the roller 13 downward. By the roller being pressed against the tube, it will push contents of the tube out of the mouth of the tube.

I claim:

1. A dispensing device for dispensing the contents of a collapsible tube comprising:

(a) a plaque for mounting on a wall having at least one protruding slot for receiving a hook support;

(b) a container housing for a collapsible dispensing tube having at least one hook fixed to a side thereof adapted to engage said protruding slot for support on said plaque (c) said container having front, back, and side walls, and top and bottom walls;

(d) said side, top and bottom walls forming two halves of said container and being hingedly connected for access thereto;

(e) flexible dispensing tube mounting and dispensing means provided in said container;

(f) said tube mounting means including spring clip means at the top of said container and aperture means in the bottom wall of said container;

(g) said dispensing means including a vertically mounted threaded drive rod driven by a sliding actuator engaging a gear fixed to said threaded drive rod, and a (h) vertically movable carriage structure disposed in said container including a vertically threaded central opening threadedly receiving said drive rod, a roller engaging said vertically disposed tube, and roller bearing means adjustable by threaded screw means in a horizontal plane within slots in said carriage to vary the roller pressure against the tube.

* * * * *